US005965067A

United States Patent [19]

Junkel et al.

[11] Patent Number: 5,965,067

[45] **Date of Patent: *Oct. 12, 1999**

[54] PORTABLE FAN DEVICE FOR USE WITH A SPRAY MISTING BOTTLE

[75] Inventors: Eric F. Junkel, Des Plaines; Linda M. Usher, Chicago, both of Ill.

[73] Assignee: Circulair, Inc., Chicago, Ill.

[ * ] Notice: This patent is subject to a terminal disclaimer.

[21] Appl. No.: 08/924,685

[22] Filed: Sep. 8, 1997

Related U.S. Application Data

[62] Division of application No. 08/522,598, Sep. 1, 1995, Pat. No. 5,667,731.

[51] Int. Cl.[6] ..... B01F 3/04

[52] U.S. Cl. ..... 261/28; 261/90; 239/222.11; 239/289; 239/375; 416/146 R; 416/244 R

[58] Field of Search ..... 261/28, 30, 84, 261/89, 90, 24; 239/77, 214.25, 222.11, 289, 302, 327, 340, 349, 351, 355, 375, 600; 416/146 R, 244 R, 247 R

[56] References Cited

U.S. PATENT DOCUMENTS

| | | | |
|---|---|---|---|
| D. 178,144 | 6/1956 | Miller . | |
| D. 220,246 | 3/1971 | Pacelli . | |
| D. 264,181 | 5/1982 | Booso . | |
| D. 292,556 | 11/1987 | Daugherty . | |
| D. 325,628 | 4/1992 | Cho . | |
| D. 349,570 | 8/1994 | Radtke . | |
| D. 349,954 | 8/1994 | Steiner et al. . | |
| 1,066,851 | 7/1913 | Siefert | 261/90 |
| 1,100,751 | 6/1914 | Lindstrom | 261/90 |
| 1,473,045 | 11/1923 | Puttaert et al. . | |
| 2,063,716 | 12/1936 | Zellweger | 261/90 |
| 2,100,923 | 11/1937 | Schmidt et al. . | |
| 2,351,226 | 6/1944 | Pernhall . | |
| 2,667,301 | 1/1954 | Lautner . | |
| 2,736,606 | 2/1956 | Kmiotek . | |
| 2,787,501 | 4/1957 | Tuma . | |
| 3,004,403 | 10/1961 | Laporte | 261/28 |
| 3,997,115 | 12/1976 | Licudine . | |
| 4,523,080 | 6/1985 | Bolton . | |
| 4,700,494 | 10/1987 | Pridgen . | |
| 4,839,106 | 6/1989 | Steiner . | |
| 5,338,495 | 8/1994 | Steiner et al. . | |
| 5,620,633 | 4/1997 | Junkel et al. | 239/375 |
| 5,667,731 | 9/1997 | Junkel et al. | 416/244 R |
| 5,667,732 | 9/1997 | Lederer | 261/90 |
| 5,837,167 | 11/1998 | Lederer | 261/89 |
| 5,843,344 | 12/1998 | Junkel et al. | 261/89 |

FOREIGN PATENT DOCUMENTS

| | | | |
|---|---|---|---|
| 580388 | 6/1930 | Germany | 261/90 |

*Primary Examiner*—C. Scott Bushey
*Attorney, Agent, or Firm*—Gifford, Krass, Groh, Sprinkle, Anderson & Citkowski, P.C.

[57] ABSTRACT

A portable fan device for use with a spray misting bottle which is capable of being mounted atop a spray applicating head portion of the misting bottle so that a fan blade unit of the fan device is positioned forwardly and in communication with an atomized spray nozzle of the spray head and cools and atomizes the mist spray issued by the nozzle. Releasable securing means such as an attachment bracket or contoured gripping tabs extending from the fan underside are employed for securing the fan body in a generally horizontal fashion atop the spray head. A stand member is held within a recessed cavity in the fan underside and can be rotated downwardly to support the fan device in an upright position for use as a portable fan once the fan body has been detached from atop the spray head. In a further embodiment, a gripping tab which forms part of the releasable securing means can provide the dual function of gripping part of the spray head and supporting the fan body in an upright position.

15 Claims, 8 Drawing Sheets

Fig-15
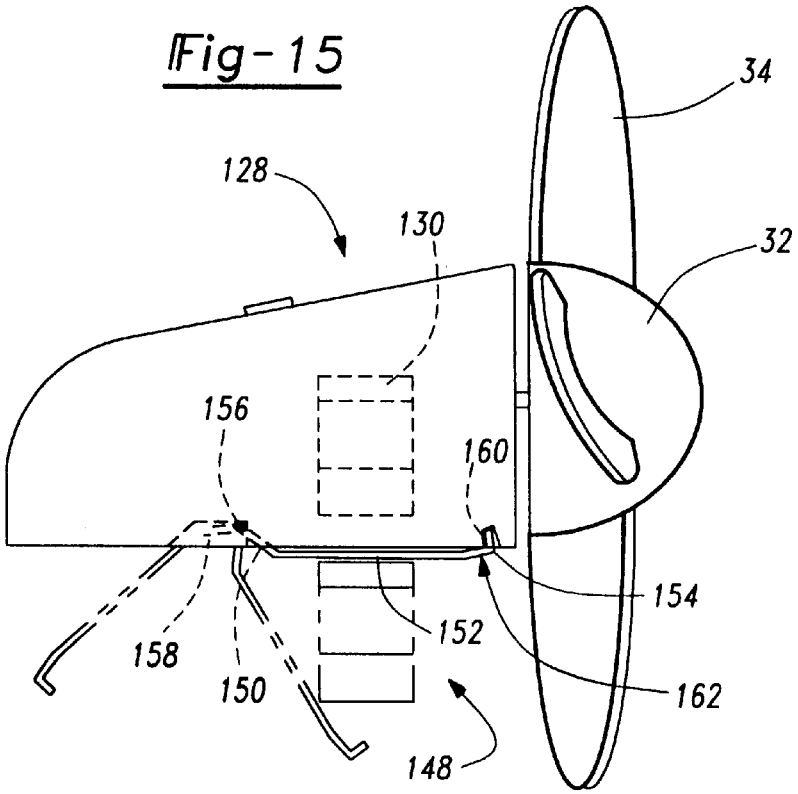
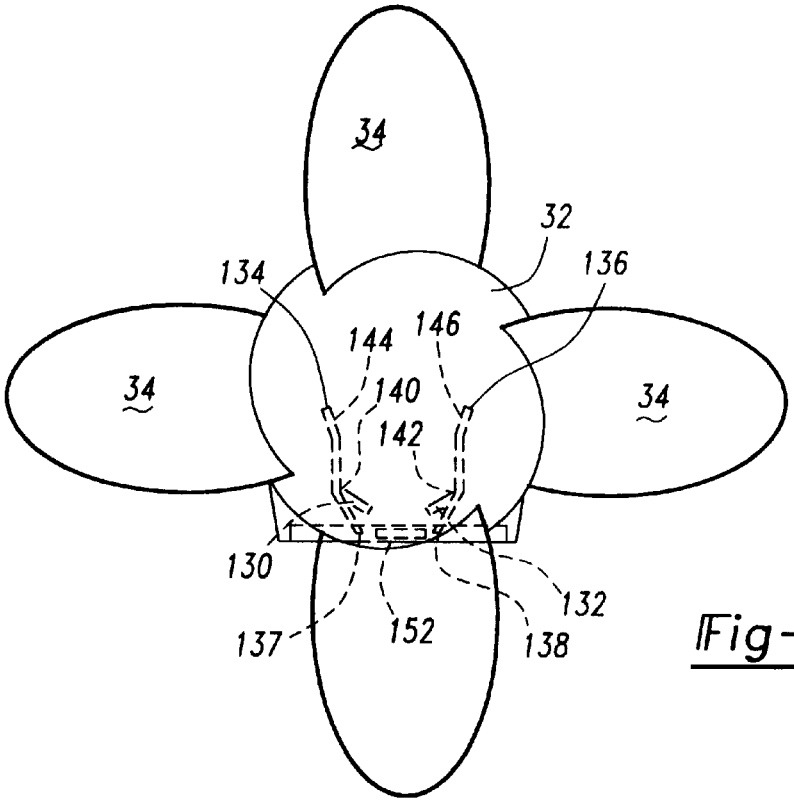
Fig-16

PORTABLE FAN DEVICE FOR USE WITH A SPRAY MISTING BOTTLE

CROSS REFERENCE TO RELATED APPLICATIONS

The present application is a divisional of Application Ser. No. 08/522,598, filed Sep. 1, 1995 and issued as U.S. Pat. No. 5,667,731 on Sep. 16, 1997, for a Portable Fan Device for Use With a Spray Misting Bottle.

BACKGROUND OF THE INVENTION

1. Field of the Invention

The present invention relates generally to fan driven misting devices and, more particularly, to a portable fan device for use with a spray misting bottle which is releasably securable to the misting bottle for use either with or apart from the bottle and which enhances the spray atomizing effect of the bottle.

2. Description of the Prior Art

Various different types of fan devices are known in the art which are portable and are capable of providing cooling comfort to a user. An example of such a device is U.S. Design Patent No. 349,570, issued to Radtke, Jr., which teaches a portable electric fan including a body enclosing a fan blade unit and a pivoting tab extending from the body upon which the body may be supported. Battery means are provided for powering the fan device.

Also known in the art are portable misting devices which incorporate a portable fan structure atop a fluid carrying reservoir base and which act as a cooling and enhanced distributing means for the issued atomized spray mist. An example of such a device is disclosed in U.S. Pat. No. 5,338,495, issued to Steiner et al., which teaches a portable misting fan. The misting fan is constructed of an integral head unit which includes a portable fan and an atomizing means separated into respective chambers and a connector which extends from the head unit and attaches the head unit atop a fluid reservoir bottle. The atomizing means includes a stem which extends into the fluid receptacle to withdraw fluid and the fan means works in combination with an outlet port of the atomizing means to cool and distribute the spray as a fine mist.

The shortcomings of the misting fan of Steiner et al. include the requirement that the atomizing means form a part of the head unit as well as the inability to detach the head unit from the receptacle bottle for use apart from the receptacle bottle. The fan means in the Steiner et al. device is therefore limited to use alone with the spray bottle.

SUMMARY OF THE PRESENT INVENTION

The present invention is a releasably securable portable fan device for use with a spray misting bottle. The spray misting bottle is of an atomizing spray variety as is conventionally known in the art and includes a fluid carrying base and a spray applicating head portion which is secured atop the base by a connector. The fan device includes a body which is attachable to the spray applicating head portion and a fan blade unit made up of a plurality of blades which are connected to the body by a shaft and extend forwardly from the body. The body forms a self-contained unit which houses a small electric motor for driving the shaft and an electrical power means such as a battery for operating the motor.

In a first preferred embodiment, an attachment bracket is secured atop the conventional spray applicating head portion and the body of the fan device is in turn engaged upon a top surface of the bracket so that the spray issued from the head portion is directed into the path of the rotating blades of the fan blade unit from the rear. Upon contact with the blades, the spray is distributed across an area defined by the air currents generated by the fan blade unit and is uniformly cooled by evaporation upon being intermingled within the air currents.

The attachment bracket may be substituted in further preferred embodiments by contoured gripping tabs which extend downwardly from the fan body and which directly attach to the top of the spray applicating head portion. The fan body as described in all of the preferred embodiments also includes a retractable stand member which is hingedly connected to an underside of the body and which may be rotated from a storage position within a recessed enclosure in an underside of the fan body when it is supported atop the spray bottle to a supporting position when it is desirable to detach the fan body from the spray bottle for use strictly as a cooling device. The stand is configured so that it does not interfere with the location of the tabs when it is rotated to a supporting position and, in certain preferred embodiments, may be used in combination with some of the tabs to support the fan device upon a planar surface. Conversely, the gripping tabs in at least one preferred embodiment may be configured so that they perform the function of the stand member when the fan is dismounted in addition to securing the body atop the spray applicating head.

BRIEF DESCRIPTION OF THE DRAWINGS

Reference will now be made to the attached drawings, when read in combination with the following specification, wherein like reference numerals refer to like parts throughout the several views, and in which:

FIG. 15 is a side view of a fan device similar to that shown in FIG. 14 and illustrating the contoured gripping tab portions of the third preferred embodiment being recessable within the fan device body according to a fourth preferred embodiment of the present invention; and FIG. 16 is a frontal view of the fan device shown in FIG. 15 and illustrating the tab portions in the recessed position within the fan body.

DESCRIPTION OF THE PREFERRED EMBODIMENT

Figure 1:
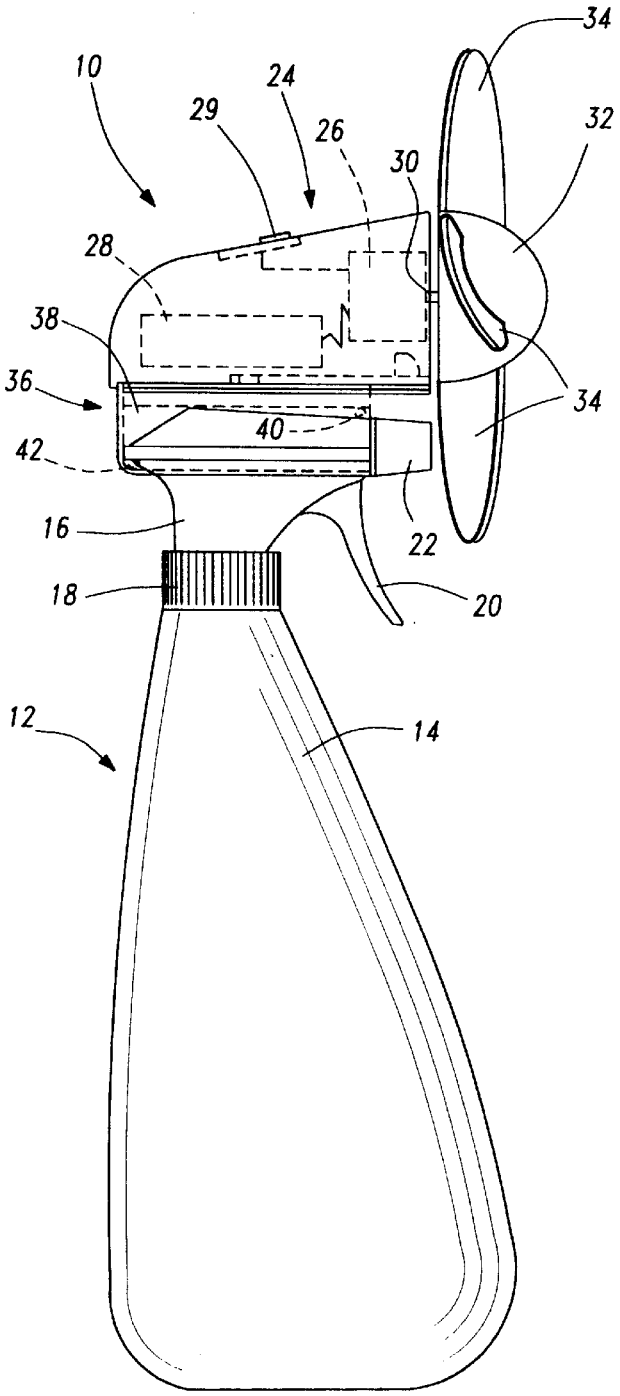
FIG. 1 is a side view of the portable fan device for use with a spray misting bottle according to a first preferred embodiment of the present invention.
Figure 2:
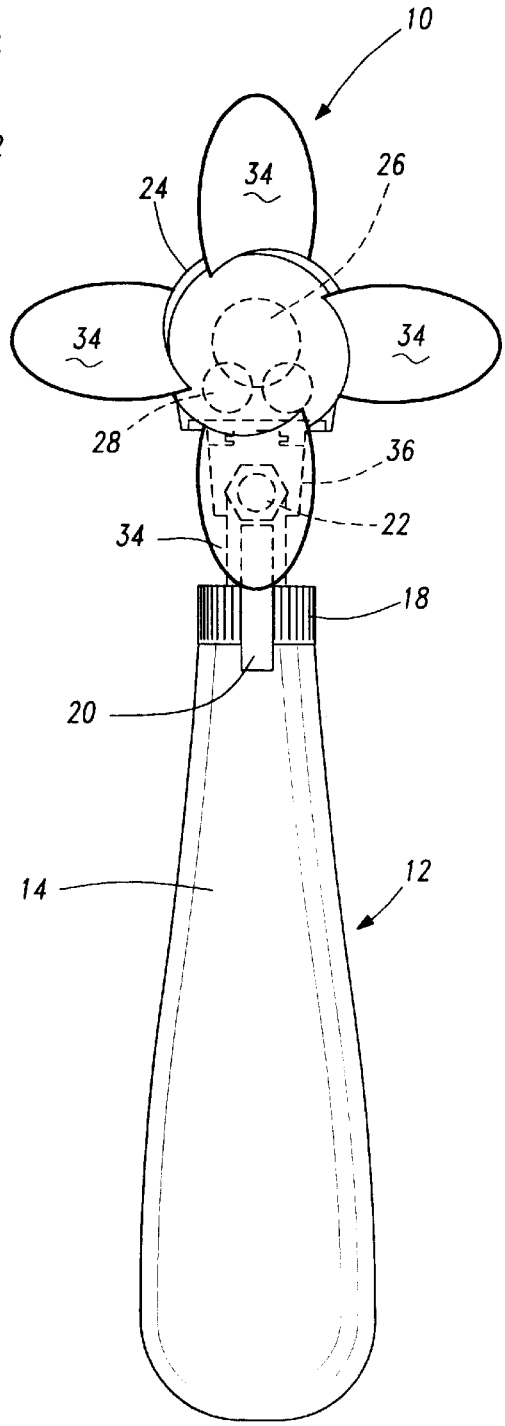
FIG. 2 is a frontal view of the first preferred embodiment according to FIG. 1 and showing the positioning of the applicator spray head of the spray misting bottle in relation to the path of rotation established by the fan blades of the fan unit.

Referring now to FIGS. 1 and 2, a portable fan device 10 for use with a spray misting bottle 12 is shown according to a first preferred embodiment of the present invention. The spray misting bottle 12 may be of a type conventionally known in the art and includes a fluid carrying base 14 of a given outline and dimension and a spray applicating head portion 16 which is connected to the base by a connector 18 and extends upwardly from the base. The connector 18 is typically a threaded attachment cap which is integrally formed with the head portion 16 and which communicates a stem portion (not shown) extending downwardly into the interior of the fluid carrying base with the spray applicating head portion. The head portion includes a trigger 20 which, when depressed, causes a volume of an atomized mist spray to be issued from a nozzle 22 formed in the applicating portion 16. The spray nozzle 22 preferably has an adjustable spray pattern for adjusting the direction and level of atomization of the mist spray. It is further understood that the shape and design of the spray bottle body and the head portions by themselves are not critical to the present invention and could be substituted by other misting bottle devices with spray applicating means as is conventionally known.

Figure 3:
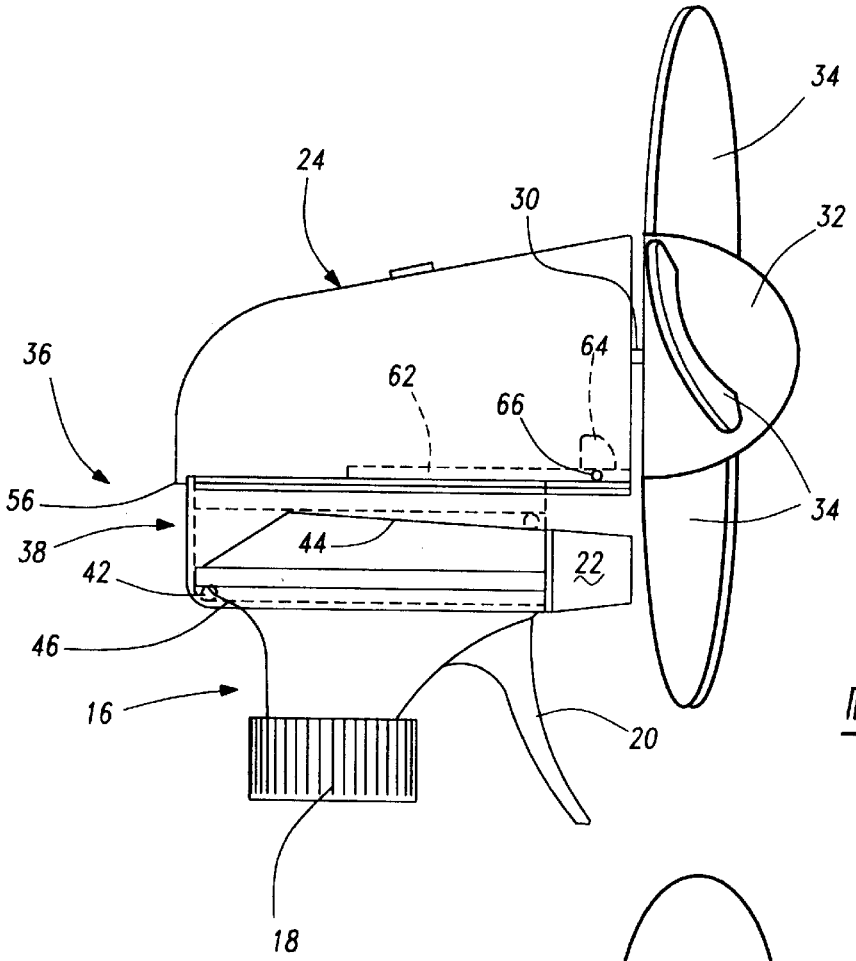
FIG. 3 is an enlarged sectional view of the fan device mounted atop the spray applicator head according to FIG. 1 and showing the attachment bracket for interengaging the fan to the head.
Figure 4:
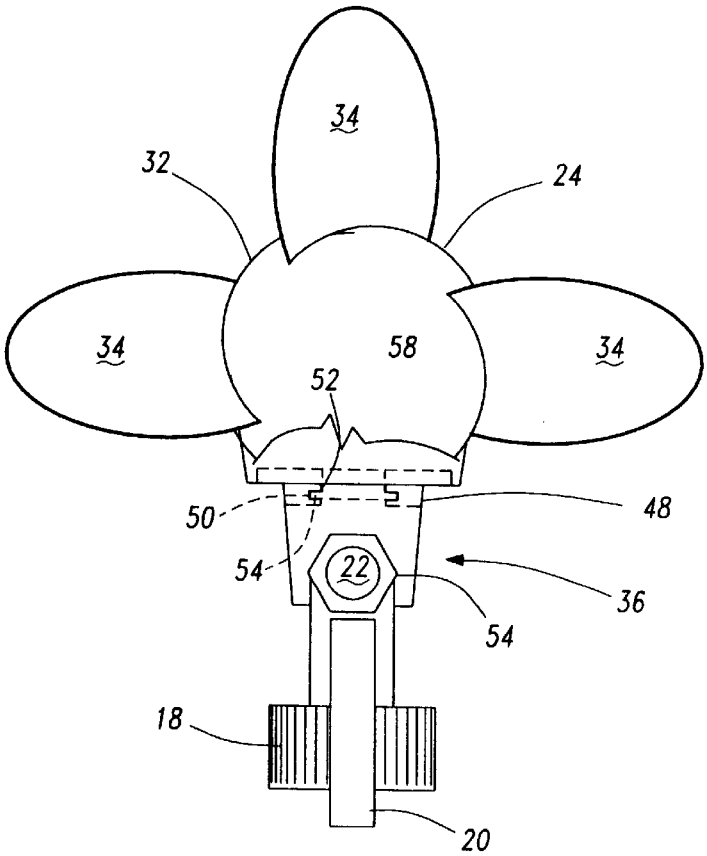
FIG. 4 is an enlarged frontal view of the fan device and spray applicator head according to FIG. 3.

Referring again to FIGS. 1 and 2, and further to FIGS. 3 and 4, the fan device 10 includes a body 24 which is shown as being substantially cylindrical in shape. The body may however be formed in any desirable shape. As can be seen in phantom in FIGS. 1 and 2, the housing of the fan body 24 encloses a small electric motor 26, such as a DC supply motor, which is operatively connected to a battery supply 28. The battery supply is preferably provided by a pair of AA batteries, as is shown in the drawing, however it is feasible that other electrical power sources could be utilized, such as an input jack from an external AC/DC outlet which would insert into an appropriate inlet port (not shown) in the fan body.

The power source provided by the batteries 28 operates the electric motor 26 upon the activation of a switch 29 in the fan body to the "ON" position which is operatively connected to the motor 26 and which in turn rotates a shaft 30 extending forwardly from the fan body 24. A fan blade unit forms a part of the portable fan device and includes a nose 32 which is connected to the forward end of the shaft 30. Extending from the nose 32 are a plurality of flexible blade portions 34 which, in combination, define a rotating circular path at a point forwardly from the fan body and which overlaps the direction of the atomized mist spray issued by the nozzle 22 of the spray applicating head. The blades 34 are constructed of a soft resilient plastic in order to be user safe and are capable of being deformed and then reverting back to their original shape in the event of accidental contact by the user.

An attachment bracket 36 according to the first preferred embodiment is provided for releasably securing the fan device onto the spray applicating head of the misting bottle. The bracket 36 has a shaped exterior and a hollow interior 38 which is shaped to correspond substantially with the shape of the spray head so that it is capable of receiving the upper portion of the spray head 16 extending rearwardly from the nozzle 22. Referring specifically to FIG. 3, the interior 38 of the attachment bracket is bounded by a first clip element 40 at an upper and forward end and a second clip element 42 at a lower and rearward end. The clip elements 40 and 42 extend the width of the bracket interior and are deformable to respectively engage surfaces 44 and 46 of the spray applicating head to releasably secure the attachment bracket in place. Alternatively, the attachment bracket may be formed in halves and the clip element replaced by screws which mount the bracket halves around the spray head. Also, the interior surfaces of the attachment bracket may be ribbed to engage the surfaces 44 and 46 of the spray head. Also, while surfaces 44 and 46 of the spray head are shown engaged by the attachment bracket, it is envisioned that the bracket can be designed to engage other surfaces of the spray head.

Referring again to FIGS. 3 and 4, an upper portion 48 of the attachment bracket includes a horizontally disposed slotted portion 50 and a narrowed central aperture portion 52 which communicates the slotted portion with a top surface of the bracket and which extends substantially the length of the bracket. A pair of longitudinally extending and outwardly directed engaging portions 54 extend from the underside of the fan body 24 and are slidingly engaged within the slotted portions 50 at a rear edge of the bracket to enable the fan body to be progressively slid forward until a rear protrusion 56 (see FIG. 3) of the fan body abuts against the rear edge of the bracket. As is best shown in FIGS. 1 and 3, the fan device is mounted atop the spray head portion of the misting bottle so that the fan blade unit is positioned forwardly and in overlapping fashion to the atomized spray head nozzle. The trigger of the spray head can be actuated so that the nozzle will issue an atomized mist spray which contacts the rear faces of the blades and which is equally and uniformly redistributed by the blades in a direction of the air currents generated by the fan device. The distributed mist spray is cooled by the air currents generated for application by the user.

Figure 5:
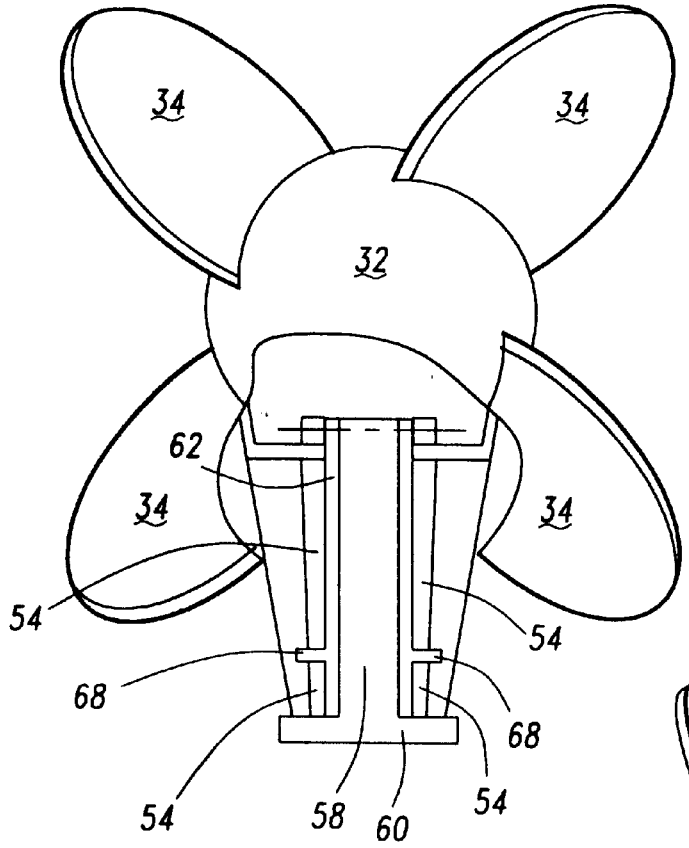
FIG. 5 is a frontal view similar to FIG. 4 and showing the fan body in a detached position from the spray misting bottle with the retractable stand member in a downwardly extending and engaged position.
Figure 6:
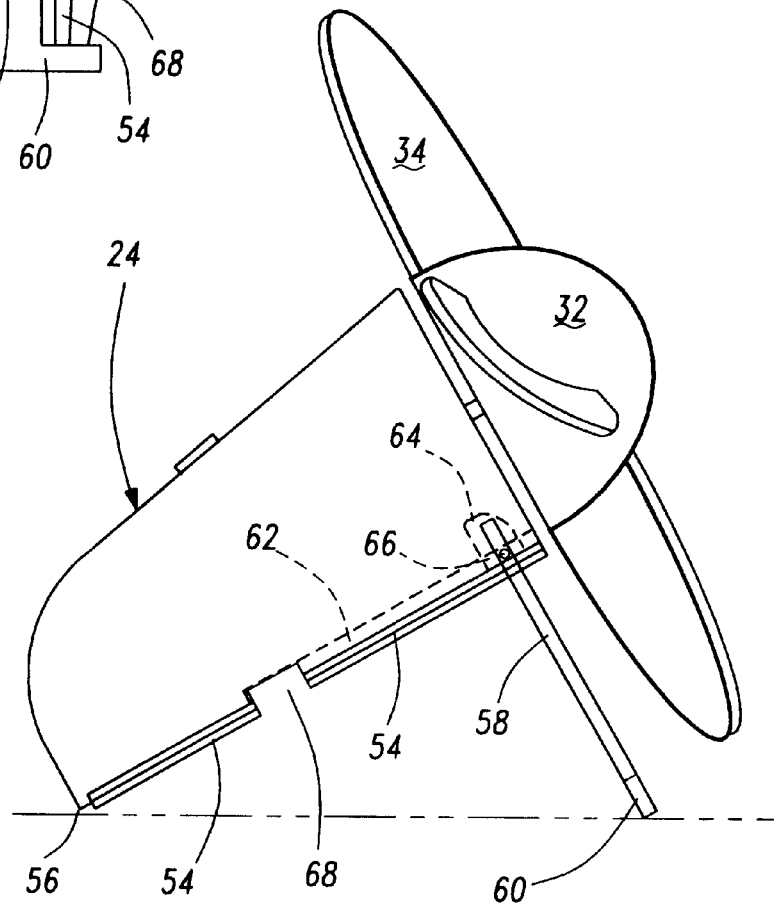
FIG. 6 is a side view of the fan body shown in FIG. 5 according to the first preferred embodiment of the present invention.

Referring again to FIGS. 3 and 4, and also to FIGS. 5 and 6, the fan device 10 of the present invention may be detached from the misting spray bottle for separate use as a stand alone fan when it is desirable not to employ the spray bottle. Specifically, a retractable stand member is provided which includes a longitudinally extending leg portion 58 and a transversely extending foot portion 60. The stand member lies flush within a recess 62 formed in the underside of the fan body when the fan is secured atop the attachment bracket, as shown in FIG. 3. Upon detaching the fan from the bracket, the stand member is rotated downwardly to the position shown in FIGS. 5 and 6 and, as seen from FIG. 5, forms a substantially upside down "T" shape to support the fan in an upright position and so that the fan blades do not contact the planar surface upon which the fan is supported. Alternatively, the stand member according to the first preferred embodiment can be formed of any shape consistent with the underside of the fan body and the recess formed in the body underside, provided the stand provides effective support to the device when required. While a T-shaped stand is shown as the preferred embodiment, it is envisioned that other stand shapes such as a U-shaped or L-shaped support may also be employed. As is seen from the combination of the frontal view of FIG. 5 and the side view of FIG. 6, the recess 62 extends rearwardly from the front of the fan body slightly more than half its longitudinal distance. A forward hinge aperture 64 is formed into the body at a forward end of the recess 62 and is shaped to allow the forward end of the stand member to rotate about its hinge point 66 from its recessed and stored position to its downwardly extending and supporting position. The foot portion 60 of the stand fits within corresponding shaped portions 68 in the fan body recess 62 and the leg 58 of the stand and associated recess 62 are dimensioned so that they do not interfere with the placement and arrangement of the outwardly directed engaging portions 54. The outwardly directed portions 68 of the recess separate the engaging portions 54 into front and rear halves, as seen from FIG. 6, and permit the stand to provide adequate support to the fan while being effectively stored during use of the fan atop the spray misting bottle.

In use, the portable fan device according to the first preferred embodiment may be slidingly engaged atop the attachment bracket which is in turn mounted to the spray applicating head for use as a spray misting device for providing a cooled and dispersed atomized mist spray. If and when desired, the fan device may be slid in a rearward direction until the engaging portions extending from the underside of the fan body clear the slotted portions formed in the attachment bracket. Upon revealing the underside recess in the fan body, the stand member is allowed to rotate downwardly about its associated hinge until the foot portion contacts the planar surface upon which the fan body is to be supported. The body is supported in an upwardly facing manner between the foot portion of the stand at a forward end and the rear edge abutting portion of the fan body at a rearward end. The fan blades of the blade unit are therefore allowed to rotate without fear of them contacting the planar surface. The fan device therefore operates as a standard portable fan unit upon being detached from the misting bottle.

Referring now to FIGS. 7–10, a portable fan device 70 is shown according to a second preferred embodiment of the present invention. The fan device 70 is identical in most respects to that disclosed in the first preferred embodiment, with the exception that the attachment bracket is substituted by a plurality of contoured gripping tabs which extend downwardly from the fan body and secure the body directly atop the spray application head portion 16.

Specifically, a first gripping tab 72 and a second gripping tab 74 extend downwardly from the underside of the fan body at connections 76 and 78 respectively. The gripping tabs 72 and 74 extend in opposing fashion to one another, with the gripping tab 72 having a first outwardly angled portion 80 and a second reversed and inwardly angled portion 82 and the gripping tab 74 having a first outwardly angled portion 84 and a second reversed and inwardly angled portion 86. As is best shown by the side view of FIG. 7 and the frontal view of FIG. 8, the gripping tabs 72 and 74 encircle the spray head 16 at a position proximate its forward end. The gripping tabs 72 and 74 are constructed of a durable and resilient plastic material and formed such that they may be deflected outwardly about their connections 76 and 78 upon the insertion of the spray head and will then revert back to substantially their original shape whereupon the spray head is held in biasing contact. As is best seen from the frontal view of FIG. 8, it is desirable for the contours of the gripping portions to match those of the spray head as closely as is practicable. However, it is understood that conventional spray head designs may vary to a fair degree and therefore the angled portions of the gripping tabs are such that they are also capable of engaging spray bottle heads which may differ in shape and contour.

Referring again to FIGS. 7 and 10, a third rear gripping tab 88 extends downwardly from the underside of the fan body proximate its rear edge. The gripping tab 88 includes a clip portion 90 at its lower extremity which is contoured to engage a corresponding ridged side 92 ringing the surface of the spray applicating head concurrent with the engagement of the gripping tabs 72 and 74 about the forward end of the spray head. The clip portion 90 of the gripping tab 88 is also capable of securing to the rear edge of the spray head in the absence of the ridged side 92.

Figure 7:
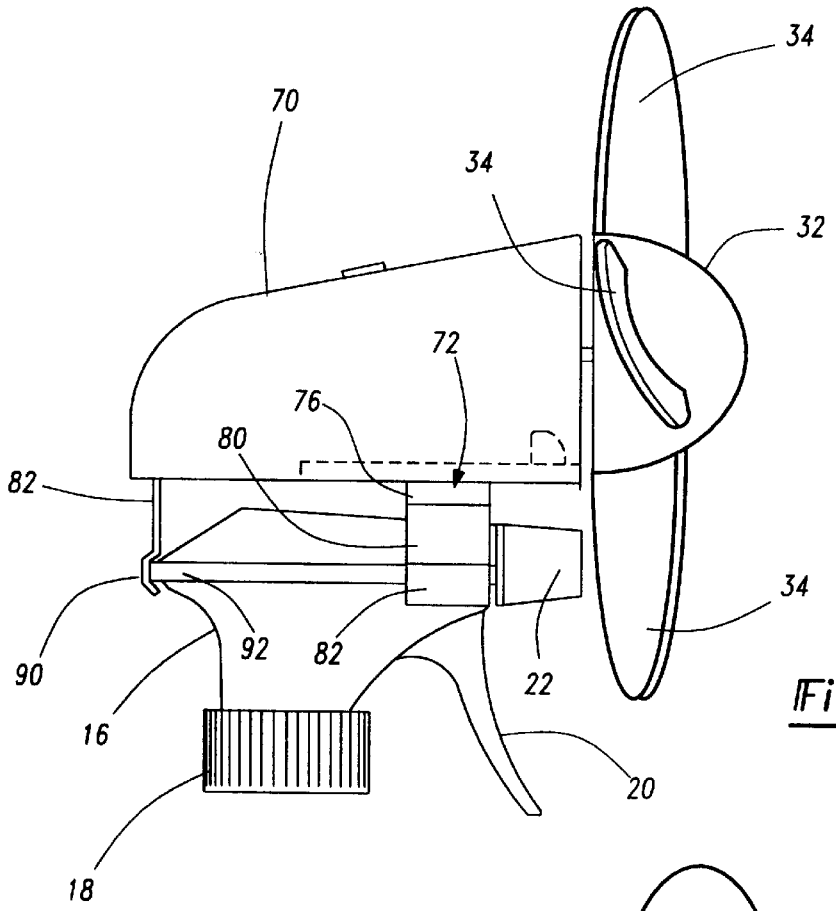
FIG. 7 is an enlarged side view of a fan device for mounting atop a spray bottle head which is similar in respects to that shown in FIG. 3 and is further according to a second preferred embodiment of the present invention.
Figure 8:
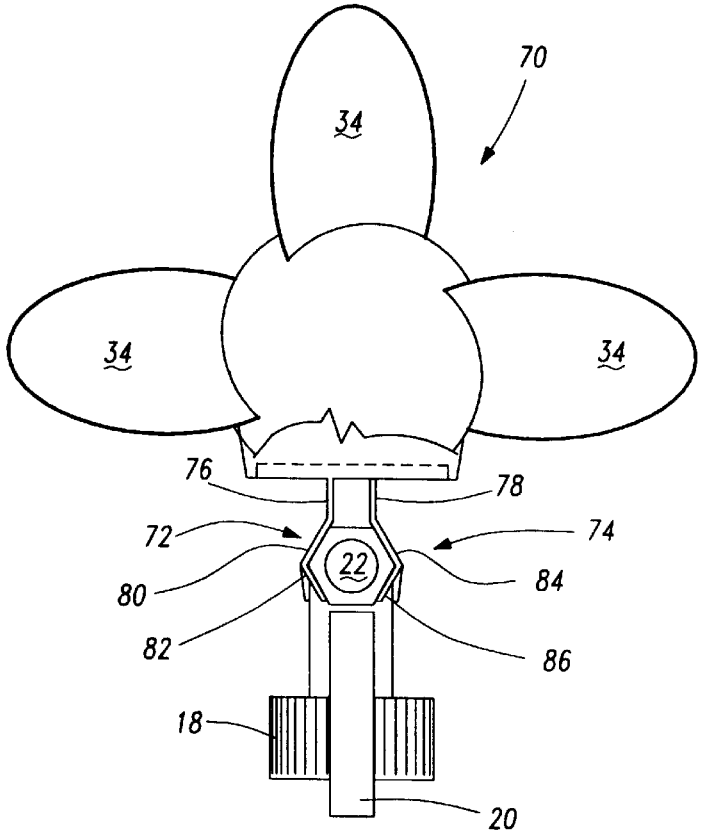
FIG. 8 is a frontal view of the fan device shown in FIG. 7 and showing the manner in which the contoured gripping tabs engage around the spray applicating head according to the second preferred embodiment of the present invention.
Figure 9:
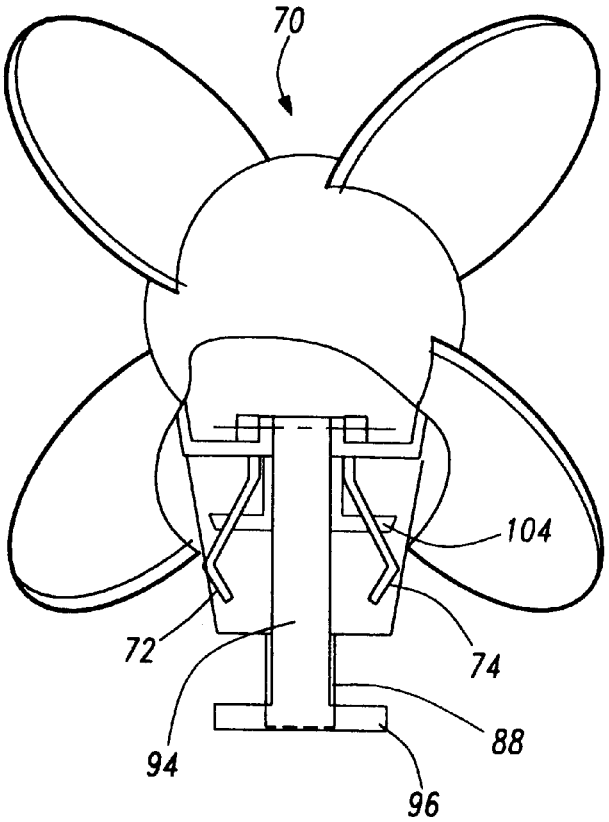
FIG. 9 is a frontal view similar to that shown in FIG. 8 of the fan body in a detached position from the spray applicating head and with the stand member in a downwardly engaged position.
Figure 10:
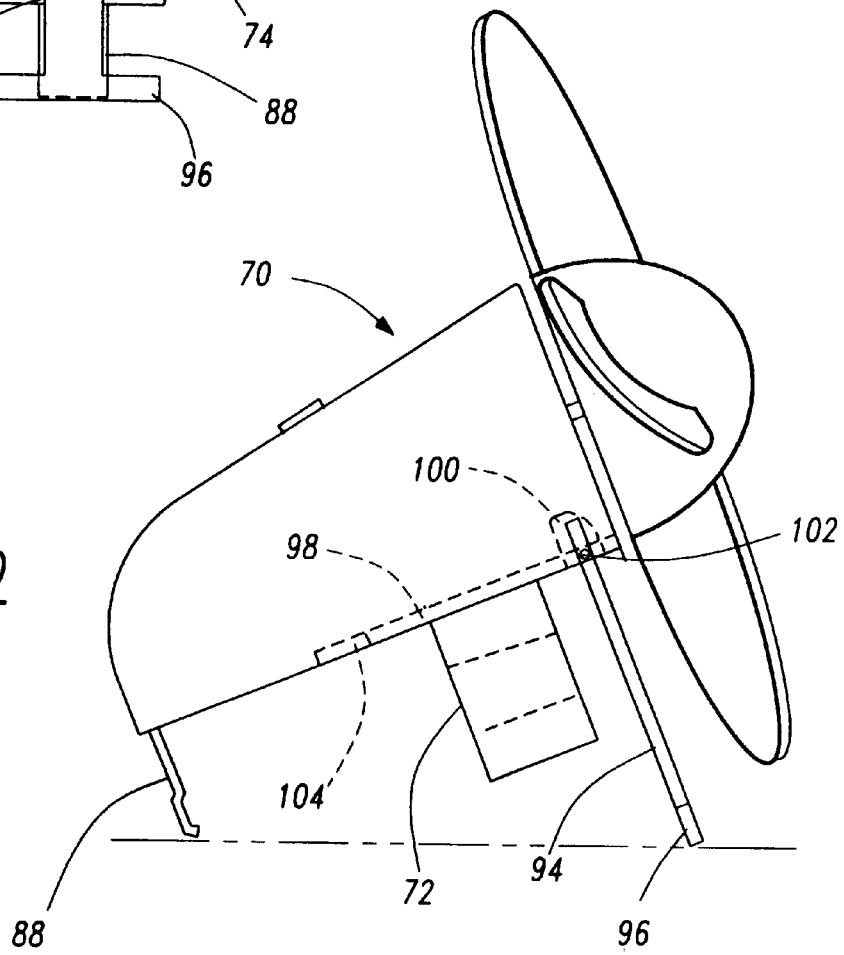
FIG. 10 is a side view of FIG. 9 and showing the stand member in combination with rearward gripping tab member for supporting the fan device on a planar surface.

The fan device shown in FIG. 7 according to the second preferred embodiment is positioned approximately identical relative to the spray applicating head in comparison with that of the first preferred embodiment shown in FIG. 3 which utilizes the attachment bracket so that the path of the fan blades is contacted by the atomized mist spray and so that the blades can redistribute and cool the atomized mist spray.

Referring again to FIGS. 9 and 10, frontal and side views of the fan device supported atop a planar surface are shown once the fan body is detached from the spray applicating head. Detachment of the fan device is accomplished by grasping the fan body and exerting an upward force so that the contoured gripping portions are expanded outwardly and disengage from around the spray head. The fan device 70 includes a stand member having a leg portion 94 and a foot portion 96 similarly to that shown in the first preferred embodiment for supporting the device in an upstanding position for use strictly as a portable fan. The stand member rotates out of a recess 98 formed in the underside of the fan body about an apertured portion 100 at a forward end and around its hinge point 102 to a downwardly extending and engaged position shown in FIG. 10. A transversely extending recessed portion 104 of the recess 98 accommodates the foot 96 of the stand when it is in its stored position shown in FIGS. 7 and 8 and the third gripping tab 88, in combination with the stand, provides the support to the fan device so that the blades of the fan unit are adequately spaced above the planar surface. The shaping of the leg portion of the stand member is such that it does not interfere with the fixed gripping tabs as it rotates out of the fan body recess and the foot portion provides adequate forward support to the device.

Referring to FIGS. 11–14, a portable fan device 106 is shown according to a third preferred embodiment of the present invention. The fan device 106 closely resembles that shown in the second preferred embodiment and includes contoured gripping tabs 108 and 110 which are largely identical to the tabs 72 and 74. The portable fan device 106 differs in that it teaches a third rearwardly extending support and gripping tab 112 which is rotatably mounted within an aperture 116 formed in the central rear portion of the underside of the fan body about a hinged connection 114. The support/gripping tab 112 includes a first straight portion 118 extending from the hinged connection 116, a second downwardly angled portion 120 which corresponds to the contour of a surface of the spray applicating head unit and a clip portion 122 which engages upon a surface of the spray head, such as the ridged side 92 which rings the head portion.

Figure 11:
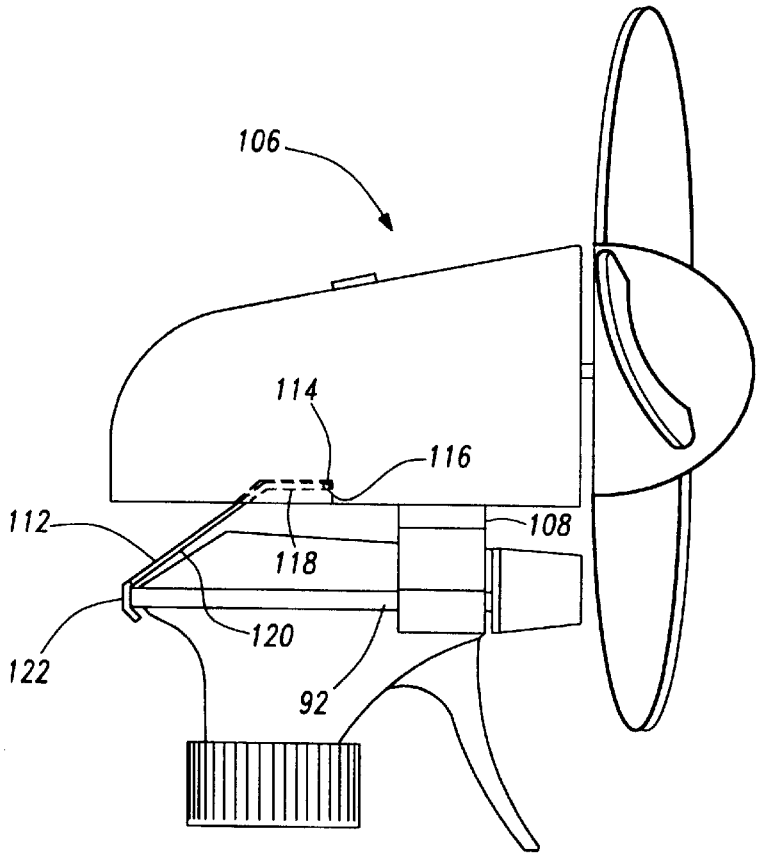
FIG. 11 is a side view of a fan device for mounting atop a spray bottle head similar in respects to those shown in FIGS. 1 and 3 and further according to a third preferred embodiment of the present invention.
Figure 12:
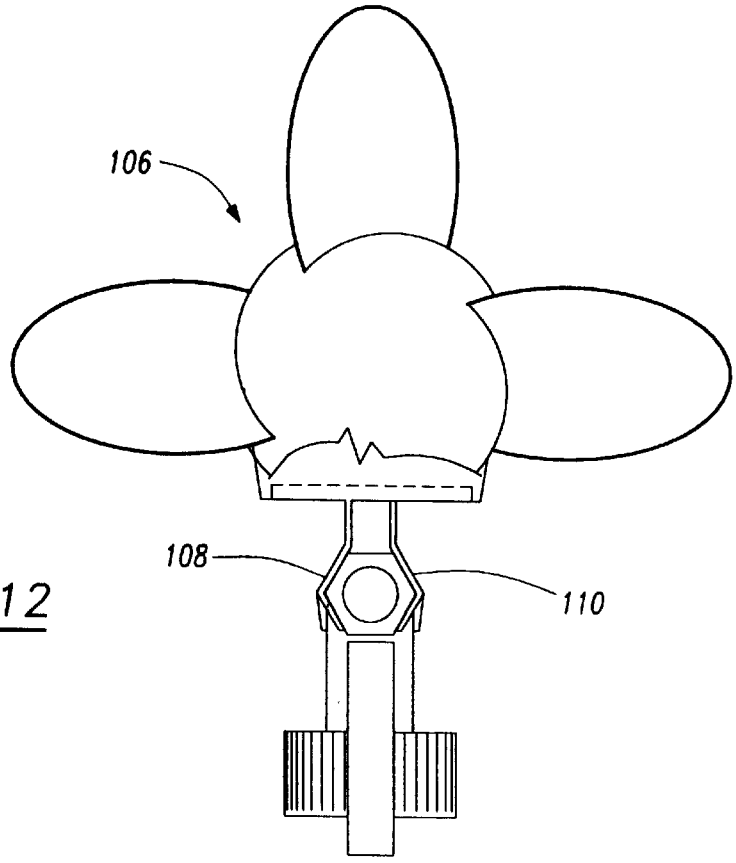
FIG. 12 is a frontal view of the fan device according to the third preferred embodiment shown in FIG. 11 secured atop the spray applicating head.
Figure 13:
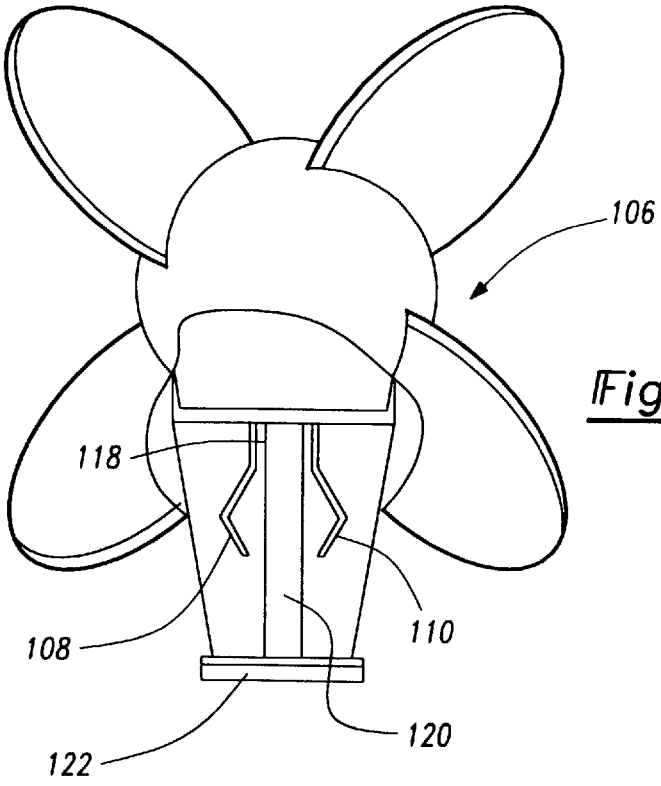
FIG. 13 is a view similar to FIG. 12 and showing the fan device in a detached position from the spray applicating head with the rear contoured gripping rotated to a position in which it performs the function of the retractable stand member according to the third preferred embodiment.
Figure 14:
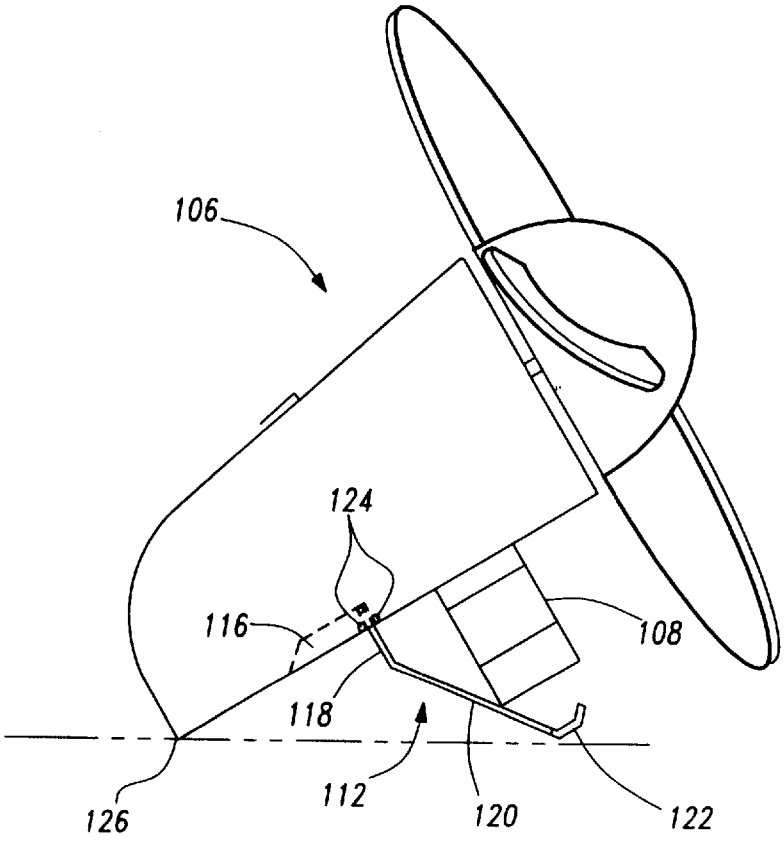
FIG. 14 is a side view of the fan device shown in FIG. 13 and showing the fan device supported upon a planar surface.

Referring now again to FIGS. 13 and 14, the fan device is shown detached from the spray misting bottle with the support and gripping tab 112 rotated from its rearward and engaged position shown in FIGS. 11 and 12 to a forward and supporting position. The gripping/support tab 112 is rotated in a counter clockwise direction until a pair of detentes 124 are engaged which resist any further rotation of the tab 112. The tab 112 is positioned just rearwardly of the gripping tabs 108 and 110 and the engaging clip portion 122 serves as a foot support. As seen from FIG. 13, the clip/foot portion 122 is of the approximate width as the feet portion of the stand members in the previous preferred embodiments and the tab 112 provides the dual function of a gripping member and stand member according to the third embodiment. The fan device 106 is therefore supported upon a surface at a forward end by the clip/foot portion 122 of the rear gripping tab 112 and at a rearward end upon a rear bottom edge 126 of the fan body.

Finally, referring to FIGS. 15 and 16, a further preferred embodiment of the fan device 128 according to the present invention is shown and is identical in most respects with the device 106 according to the third preferred embodiment with the exception that the forward contoured gripping tabs 130 and 132 are recessable into apertures 134 and 136 formed into the fan body. An outline of gripping tab 130 recessed into the fan body is shown in phantom in FIG. 15 and a frontal view of both tabs 130 and 132 substantially held within their associated recesses is shown in FIG. 16. Tab 130 includes a projecting finger 137 and tab 132 a projecting finger 138 which may be grasped by the user to withdraw the tabs 130 and 132 to a position in which they may be secured to the spray applicating head. Referring again to FIG. 16, the recess 134 includes an angled connection 140 and the recess 136 an angled connection 142. The purpose of the angled connections is to both define the extent at which the tabs are to be withdrawn for securing to the spray applicating head and to provide an effective stop which prevents further withdrawal of the tabs. The tabs may therefore be withdrawn to the point at which upper portions 144 and 146 of the tabs engage the stops 140 and 142, at which the tabs have been withdrawn to an effective distance in which they may be secured to the spray applicating head.

A gripping tab/stand member 148 according to this further preferred embodiment is substantially identical to the tab 122 and includes a straight portion 150, an angled body portion 152 and a clip portion 154. The tab and support 148 is hingedly connected at 156 to the fan body and an aperture 158 in the body is formed so that the tab and support 148 may rotate to a position at which it extends forwardly and abuts flush against the underside of the fan body. The clip portion 154 is recessed slightly in a pressure fit in a groove 160 formed into the fan body and a finger portion 162 extends from the clip portion 154 which may be grasped by a user to rotate the tab 148 out of the groove. The purpose of the recessed tabs 130 and 132 and the tab 148 is to provide an additional embodiment in which the fan may be conveniently hand held during use once it has been detached from the spray applicating head.

The present invention therefore provides a portable fan device for use both with a misting spray bottle in which it is mounted atop a spray applicating head and separately as a portable fan device.

Having described my invention, numerous additional embodiments will become apparent to one skilled in the art to which it pertains without deviating from the scope of the appended claims.

I claim:

1. A portable fan device for use with a spray misting bottle, the spray misting bottle having a fluid carrying base and a spray applicating head portion, said fan device comprising:

a body;

a fan blade unit including a plurality of blades connected to said body by a shaft and extending forwardly from said body;

said body housing a motor means for driving said shaft and an electrical power means for operating said motor means;

means for supporting said fan device in an upstanding position upon said fan device being dismounted from atop the spray applicating head; and means for releasably securing said fan device to the spray applicating head portion so that said fan blades are arranged in a substantially overhead and forwardly spaced location relative to the spray applicating head portion and so that a misting spray issued by the head portion is directed into a path of said fan blades and, upon contact with said blades, said misting spray evaporates so that air in the vicinity of said fan blades is cooled and distributed by said fan blades.

2. The portable fan device for use with a spray misting bottle as described in claim 1, said supporting means comprising a stand member having a leg portion and a foot portion extending from said leg portion, said leg portion being hingedly connected to an underside of said body and said stand member being rotatable from a first position in which it lies substantially flush against said underside of said body to a second position in which said foot portion is engaged upon a planar surface and said rotating path of said fan blade unit clears said planar surface.

3. The portable fan device for use with a spray misting bottle as described in claim 2, further comprising a recess extending along said underside of said body, said recess corresponding in configuration with said stand member and said stand member being held within said recess when said fan device is mounted atop said spray applicating head.

4. The portable fan device for use with a spray misting bottle as described in claim 1, said motor means comprising an electrical motor.

5. The portable fan device for use with a spray misting bottle as described in claim 1, said electrical power means comprising a battery supply.

6. The portable fan device for use with a spray misting bottle as described in claim 1, said fan blades being constructed of a plastic.

7. A combination portable fan device and spray misting bottle, comprising:

said spray misting bottle including a fluid carrying base, a spray applicating head, and a connector for attaching said spray applicating head onto said fluid carrying base;

said portable fan device including a body, a fan blade unit having a plurality of blades connected to said body by a shaft and extending forwardly from said body;

said body housing a motor means for driving said shaft and an electrical power means for operating said motor means;

means for supporting said fan device in an upstanding position upon said fan device being dismounted from atop said spray applicating head; and means for releasably securing said fan device to said spray applicating head so that said fan blades are arranged in a substantially overhead and forwardly spaced location relative to said spray applicating head portion and so that a misting spray issued by said head is directed into a path of said fan blades and, upon contact with said blades, said misting spray evaporates so that air in the vicinity of said fan blades is cooled and distributed by said fan blades.

8. The combination portable fan and spray misting device as described in claim 7, said supporting means further comprising a st and member having a leg portion and a foot portion extending from said leg portion, said leg portion being hingedly connected to an underside of said fan device body and said stand member being rotatable from a first position in which it lies substantially flush against said underside of said body to a second position in which said foot portion is engaged upon a planar surface and said rotating path of said fan blade unit clears said planar surface.

9. The combination portable fan and spray misting device as described in claim 8, further comprising a recess extending along said underside of said fan device body, said recess corresponding in configuration with said stand member and said stand member being held within said recess when said fan device is mounted atop said spray applicating head.

10. The combination portable fan and spray misting device as described in claim 7, said motor mean s comprising an electrical motor.

11. The combination portable fan and spray misting device as described in claim 7, said electrical power means comprising a battery supply.

12. The combination portable fan an d spray misting device as described in claim 7, said fan blade s being constructed of a plastic.

13. A combination portable fan device and spray misting bottle, comprising:

said spray misting bottle including a fluid carrying base, a spray applicating head, and a connector for attaching said spray applicating head onto said fluid carrying base;

said portable fan device including a body, a fan blade unit having a plurality of blades connected to said body by a shaft and extending forwardly from said body;

said body housing a motor means for driving said shaft and an electrical power means for operating said motor means;

means for releasably securing said fan device to said spray applicating head so that a misting spray issued by said head is directed into a path of said fan blades and, upon contact with said blades, said misting spray evaporates so that air in the vicinity of said fan blades is cooled and distributed by said fan blades; and said means for releasably securing further including an attachment bracket which secures over said spray applicating head, said attachment bracket being substantially shaped to define a hollow interior for receiving said spray applicating head, a pair of engaging portions being provided at forward and rearward edges of said interior and biasing against associated surfaces of said applicating spray head, said attachment bracket having an inwardly slotted upper surface which receives corresponding engaging portions extending longitudinally along a bottom surface of said body of said portable fan device for slidingly engaging said body onto said attachment bracket.

14. A portable fan device for use with a spray misting bottle, the spray misting bottle having a fluid carrying base and a spray applicating head portion, said fan device comprising:

a body;

a fan blade unit including a plurality of blades connected to said body by a shaft and extending forwardly from said body;

said body housing a motor means for driving said shaft and an electrical power means for operating said motor means; and means for releasably securing said fan device to the spray applicating head portion so that said fan blades are arranged in a substantially overhead and forwardly spaced location relative to the spray applicating head portion, said means for releasably securing further comprising an attachment bracket which secures over the spray applicating head portion, said attachment bracket having an inwardly slotted upper surface which receives corresponding engaging portions extending longitudinally along a bottom surface of said body for slidingly engaging said body onto said attachment bracket and so that a misting spray issued by the head portion is directed into a path of said fan blades and, upon contact with said blades, said misting spray evaporates so that air in the vicinity of said fan blades is cooled and distributed by said fan blades.

15. The portable fan device for use with a spray misting bottle as described in claim 14, said attachment bracket is substantially shaped to define a hollow interior for receiving the spray applicating head, a pair of engaging portions being provided at forward and rearward edges of said interior and biasing against the surfaces of the spray head.

* * * * *

UNITED STATES PATENT AND TRADEMARK OFFICE

CERTIFICATE OF CORRECTION

PATENT NO. : 5,965,067

DATED : October 12, 1999

INVENTOR(S) : Eric Junkel et al.

It is certified that error appears in the above-identified patent and that said Letters Patent is hereby corrected as shown below:

Column 9, line 18 - Replace "st and" with "stand".
Column 9, line 33 - Replace "mean s" with "means".
Column 9, line 38 - Replace "an d" with "and".
Column 9, line 39 - Replace "blade s" with "blades".

Signed and Sealed this

Seventeenth Day of October, 2000

*Attest:*

Q. TODD DICKINSON

*Attesting Officer*

*Director of Patents and Trademarks*